United States Patent [19]

Anzai

[11] 4,379,441

[45] Apr. 12, 1983

[54] SYSTEM FOR CONTROLLING THE AIR-FUEL RATIO IN A COMBUSTION ENGINE

[75] Inventor: Makoto Anzai, Yokosuka, Japan

[73] Assignee: Nissan Motor Company, Limited, Yokohama, Japan

[21] Appl. No.: 752,961

[22] Filed: Dec. 21, 1976

Related U.S. Application Data

[62] Division of Ser. No. 625,666, Oct. 24, 1975, abandoned.

[30] Foreign Application Priority Data

Oct. 25, 1974 [JP] Japan ..... 49-123110
May 13, 1975 [JP] Japan ..... 50-55500

[51] Int. Cl.[3] ..... F02B 75/10

[52] U.S. Cl. ..... 123/440; 60/276; 60/285

[58] Field of Search ..... 123/32 EE, 119 EC, 440, 123/489; 60/276, 285

[56] References Cited

U.S. PATENT DOCUMENTS

| | | | |
|---|---|---|---|
| 3,548,792 | 12/1970 | Palmer | 123/119 EC |
| 3,738,341 | 6/1973 | Loos | 60/276 |
| 3,745,768 | 7/1973 | Zechnall et al. | 60/276 |
| 3,782,347 | 1/1974 | Schmidt et al. | 60/276 |
| 3,939,654 | 2/1976 | Creps | 123/119 EC |
| 3,998,189 | 12/1976 | Aoki | 60/276 |
| 4,019,474 | 4/1977 | Nishimiya et al. | 60/276 |
| 4,029,061 | 6/1977 | Asano | 60/276 |
| 4,031,866 | 6/1977 | Asano | 60/276 |
| 4,052,968 | 10/1977 | Hattori et al. | 123/119 EC |

*Primary Examiner*—Sheldon J. Richter

[57] ABSTRACT

Improvement is introduced in a conventional feedback control system for supplying an optimal air-fuel mixture to an internal combustion engine on the basis of a sensed component of exhaust gases thereof. The conventional system generally comprises: a sensor, such as an oxygen analyzer, for sensing a component of exhaust gases of the internal combustion engine, the sensor being deposited in an exhaust line generating an electrical signal representative of the sensed component, a differential signal generator being connected to the sensor for generating an electrical signal representative of a differential value between the signal from the sensor and a reference signal, the reference signal being previously determined in due consideration of an optimal supply of an air-fuel mixture to the engine for maximizing the efficiency of a catalytic reactor, a controller including an integrator such as, for example, a p-i (proportional-integral) controller being connected to the differential signal generator, and another controller for generating a control signal connected to the p-i controller, the control signal being fed to an air-fuel regulating means for supplying an optimal air-fuel mixture to the engine, wherein the integrator of the p-i controller is substituted by one or two simple circuits embodying the present invention for simplifying the p-i controller without reducing the efficiency thereof.

2 Claims, 8 Drawing Figures

FIG. 5
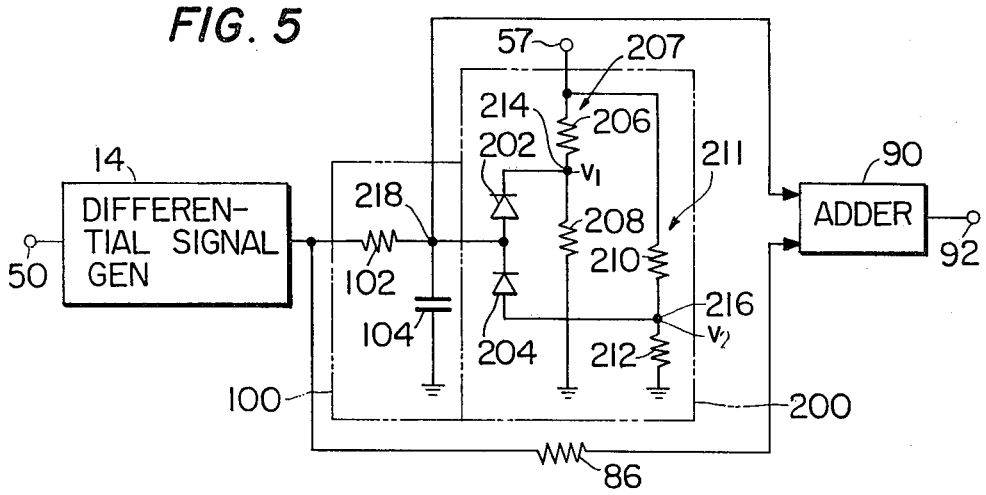
FIG. 6
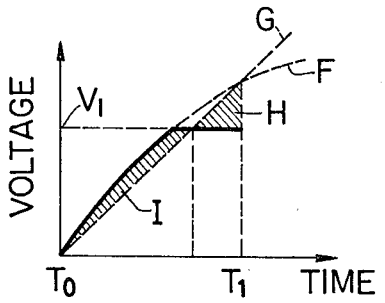
FIG. 7a
FIG. 7b
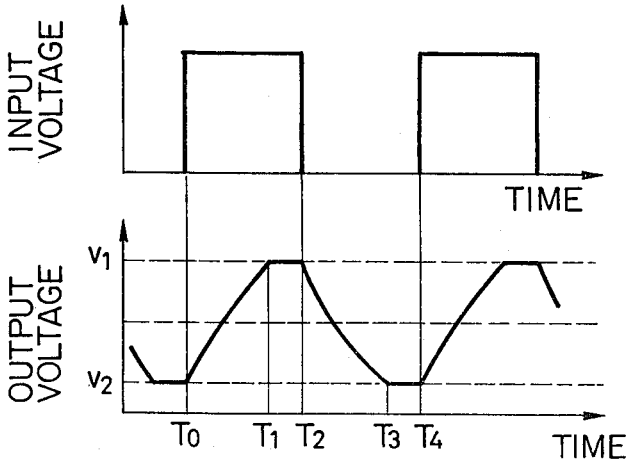

SYSTEM FOR CONTROLLING THE AIR-FUEL RATIO IN A COMBUSTION ENGINE

This is a division, of application Ser. No. 625,666, filed Oct. 24, 1975 now abandoned.

The present invention relates generally to a feedback control system for supplying an optimal air-fuel mixture to an internal combustion engine on the basis of a sensed component of exhaust gases of the engine, and particularly to the above-mentioned feedback control system which includes an improved or modified controller as part thereof in order to simplify the system without reducing the efficiency thereof.

Various systems have been proposed to supply an optimal air-fuel mixture to an internal combustion engine in accordance with the mode of engine operation, one of which is to utilize a concept of feedback control of the air-fuel ratio of the air-fuel mixture supplied to the engine on the basis of a sensed component of exhaust gases of the engine. The system generally comprises: a sensor, such as an oxygen analyzer, for sensing a component of exhaust gases of the internal combustion engine, the sensor being deposited in an exhaust line generating an electrical signal representative of the sensed component, a differential signal generator being connected to the sensor for generating an electrical signal representative of a differential value between the signal from the sensor and a reference signal, the reference signal being previously determined in due consideration of, for example, an optimal supply of an air-fuel mixture to the engine for maximizing the efficiency of a catalytic reactor, a controller including an integrator such as, for example, a p-i (proportional-integral) controller provided with an integrator being connected to the differential signal generator, and another controller for generating a control signal being connected to the p-i controller, the control signal being fed to an air-fuel regulating means for supplying an optimal air-fuel mixture to the engine.

The present invention is concerned with an improvement of the above-mentioned p-i controller.

The object of the present invention is to incorporate simple one or two circuits into the conventional p-i controller as a substitution of a complicated circuit thereof in order to simplify the p-i controller, in other words, the overall system, without reducing the efficiency thereof.

This and other objects, features and many of the attendant advantages of this invention will be appreciated more readily as the invention becomes better understood by the following detailed description, when considered in connection with the accompanying drawings, wherein like parts in each of the several figures are identified by the same reference characters, and wherein:

FIG. 5 shows other schematic circuit diagram embodying the present invention; and FIGS. 6, 7*a* and 7*b* are graphs illustrating waveforms for the purpose of explanation of the operation of the FIG. 5 circuit.

Figure 1:
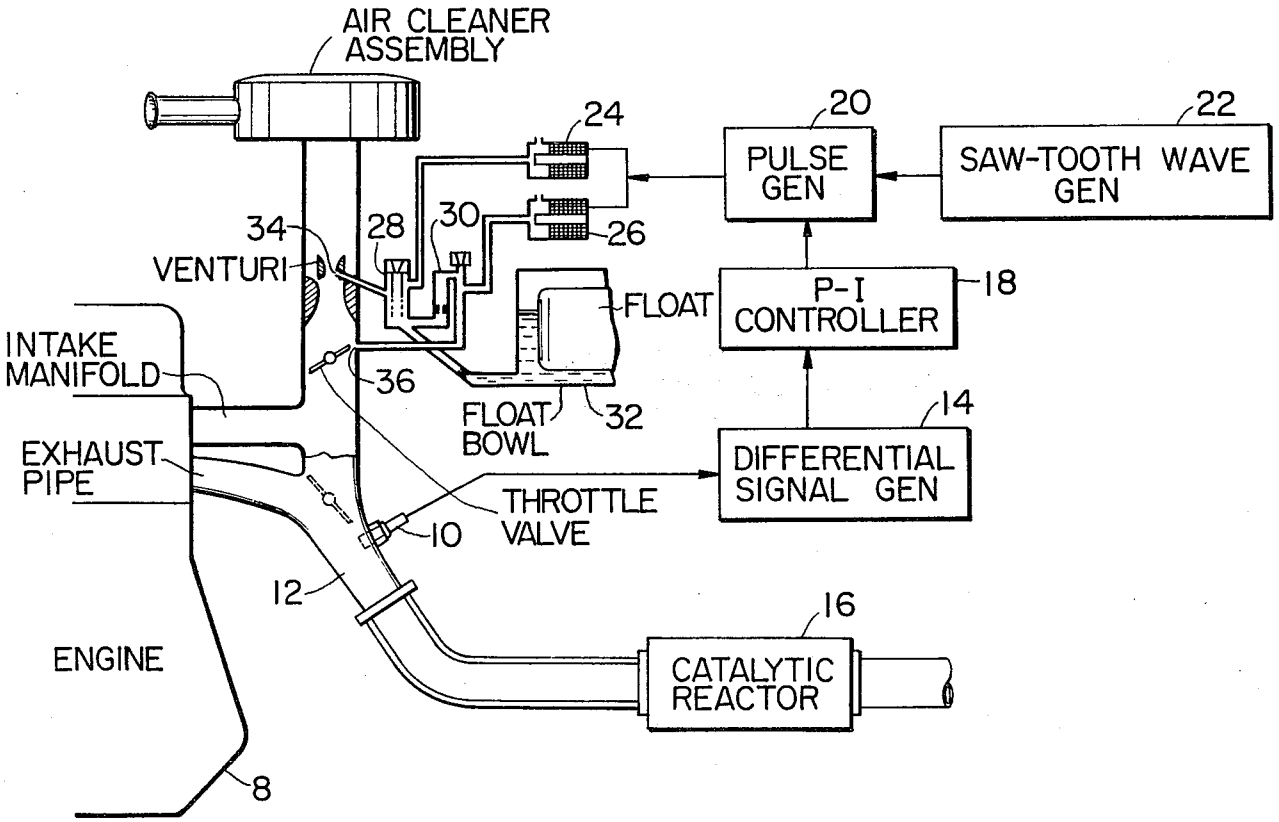
PRIOR ART FIG. 1
FIG. 1 shows a conventional feedback control system for supplying an optimal air-fuel mixture to an internal combustion engine on the basis of a sensed component of exhaust gases of the engine.
Figure 2:
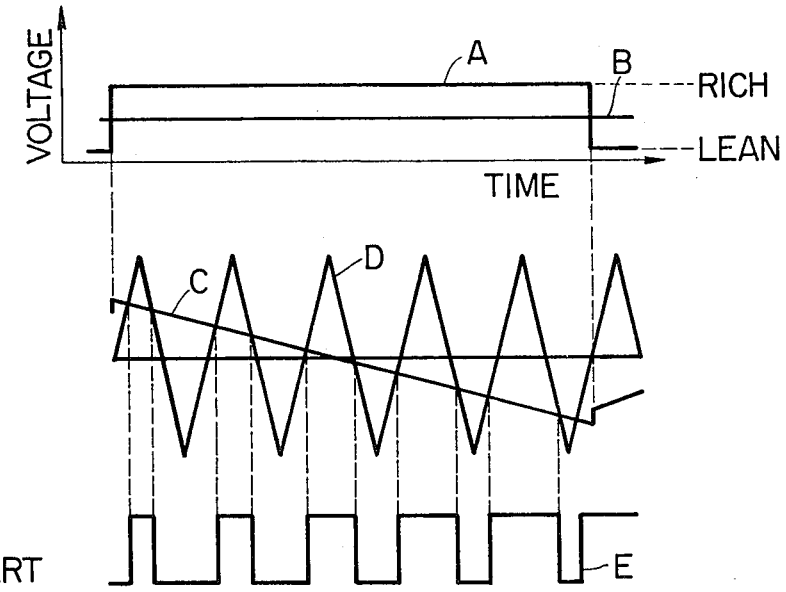
FIG. 2 is a graph illustrating various waveforms generated at different element of the FIG. 1 system.

Reference is now made to FIGS. 1 and 2, wherein schematically illustrated are a conventional feedback control system (FIG. 1) and several waveforms developed at or derived from different elements of the FIG. 1 system (FIG. 2). The feedback control system, in brief, directed to supply an optimal air-fuel mixture to an internal combustion engine 8. A sensor 10, such as an oxygen analyzer, for sensing a component of exhaust gases is disposed in an exhaust line 12 in such a manner as to be exposed to the exhaust gases. An electrical signal derived from the sensor 10 is fed to a differential signal generator 14 which generates an electrical signal representative of a differential value between the signal from the sensor 10 and a reference signal. A portion of waveform of the signal from the sensor 10 is depicted by reference character A in FIG. 2. The reference signal, which is illustrated by reference character B in FIG. 2, is previously determined in due consideration of optimal supply of an air-fuel mixture to the engine 8 for maximizing the efficiency of a catalytic reactor 16, etc. The signal representative of the differential value from the differential signal generator 14 is then fed to a conventional p-i (proportional-integral) controller 18. The provision of the p-i controller 18, as is well known, is to improve the efficiency of the feedback control system, in other words, to rapid a transient response and to gain a high stability of the system. The output system from the p-i controller 18, which is depicted by reference character C in FIG. 2, is fed to the next stage, viz., a pulse generator 20 which also receives signals having a waveform, for example, saw-tooth waves (D in FIG. 2) from a saw-tooth wave generator 22 to generate a train of pulses as shown by reference character E in FIG. 2. The width of each pulse of the train of pulses E corresponds to a duration while the signal D is larger than the signal C as schematically shown in FIG. 2. The train of pulses E is then fed to electromagnetic valves 24 and 26 to control on-off operation thereof such that, for example, the peak and base values of the pulses E cause ON and OFF actions of the valves, respectively. The valves 24 and 26 are operatively connected to main and slow air-bleed chambers 28 and 30, respectively, in order to regulate the amount of air being admixed with fuel from a float bowl 32. The air-fuel mixture is thus regulated and emitted into the engine 8 through nozzles 34 and 36. In FIG. 1, only two electromagnetic valves 24 and 26 are illustrated in such a manner as to be operatively connected to the two air-bleed chambers 28 and 30, however, other electromagnetic valve (not shown) can be provided in fuel pipe to regulate the amount of fuel to be mixed with air.

Figure 3:
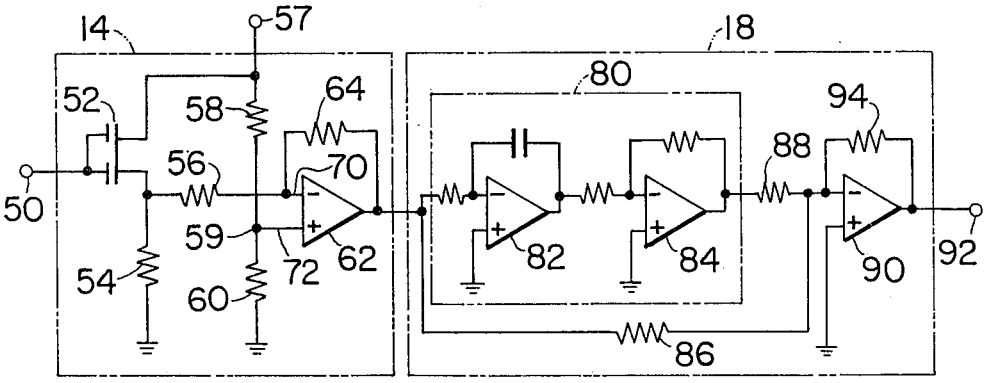
PRIOR ART FIG. 3
FIG. 3 shows a schematic circuit diagram of the element of FIG. 1 system.

In FIG. 3, the conventional differential signal generator 14 and the p-i controller 18 of the FIG. 1 system are illustrated somewhat in detail. A terminal 50 is connected to the sensor 10 for receiving the electrical signal therefrom feeding the same to a transistor amplifier 52. The amplifier 52 is preferably a FET (field effect transistor) because of its high input impedance. The source of the FET 52 is directly connected to a positive power terminal 57 and the drain thereof is grounded through a resistor 54. The output of the FET 52 is fed through a resistor 56 to one input terminal 70 of an operational amplifier 62. On the other hand, to the other terminal 72 of the amplifier 62 is fed a fixed voltage which is developed at a junction 59 between resistors 58 and 60 which serve as a voltage divider. The output terminal of the amplifier 62 is connected through a feedback resistor 64 to the terminal 70. The output signal from the amplifier 62 is then fed to a conventional integrator 80 which consists, in this case, of two operation amplifiers 82, 84, resistors (no numerals), and a capacitor (no numeral). The integrator 80 can generate an output signal with an ideal integration property. The detailed description about the conventional integrator 80 is omitted for the purpose of simplicity in that it is very familiar to those skilled in the art. The output signal from the integrator 80 is then fed through a resistor 88 to an adder 90 to which also applied is the output signal from the amplifier 62 over a resistor 86. Thus, the signal C in FIG. 2 developes at an output terminal 92. The output terminal 92 is connected through a feedback resistor 94 to one terminal of the adder 90 as shown, and the other terminal is grounded.

Figure 4:
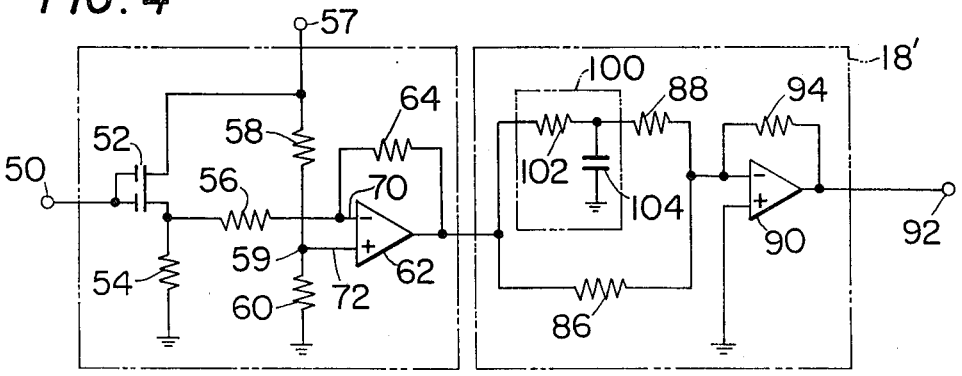
FIG. 4 shows a schematic circuit diagram embodying the present invention.

Reference is now made to FIG. 4, wherein a first preferred p-i controller 18' embodying the present invention is illustrated. The circuit of FIG. 4 is similar to that of FIG. 3 except that the integrator 80 of the latter is substituted by a circuit 100. The circuit 100 is a combination of a resistor 102 and a capacitor 104, so that it has, as is well known, a characteristic of time lag of first order. The substitution of the circuit 100 for the integrator 80 is based upon the fact that the pulse duration of the signal from the sensor 10 is considerably small so that an ideal integrator such as 80 is not necessarily required. Owing to the above-mentioned replacement, desirable simplification of the circuit arrangement of the p-i controller can be carried out with a smaller cost. In the above, it goes without saying that the capacitance of the capacitor 104 and the resistance of the resistor 102 are determined to take the most desirable values in consideration of the overall system performance.

In FIG. 5, a second embodiment of the invention is illustrated as comprising the RC integrator 100 as referred to above to provide nonlinear integration of the differential output and a clamping circuit 200 connected to the RC nonlinear integrator which constitutes an integral controller. A proportional controller as formed by a resistor 86 may be connected to the output of the differentiator 14. The outputs from both controllers are supplied to the input terminals of an adder 90 to provide summation of the two inputs to an output terminal 92.

The RC integrator formed by resistor 102 and capacitor 104 generates a nonlinearly varying voltage signal which is applied to the junction between a diode 202 and a diode 204. Diode 202 is poled to conduct current from the capacitor 104 to a first reference setting point 214 formed by the junction of resistors 206 and 208 connected in a series circuit between voltage supply terminal 57 and ground. Diode 204 is poled to conduct current through the capacitor 104 to ground from a second reference setting point 216 formed by the junction of resistors 210 and 212 connected in a series circuit between the voltage supply terminal 57 and ground. When the voltage across the capacitor 104 is above the first reference level $V_1$ at point 214, the diode 202 is rendered conductive so that the capacitor voltage is clamped to the first setting level.

The embodiment of FIG. 5 compensates for the deviation of the nonlinearly varying output from the linearly varying output of the linear integrator 80.

The compensation is provided by selecting the first reference level $V_1$ such that the integration of a voltage which lies between the linearly varying voltage G (see FIG. 6) and the nonlinearly varying voltage F and the voltage level $V_1$ equals to the integration of a voltage which lies between the voltage level $V_1$ and the linearly varying voltage which occurs before it intersects the nonlinear voltage G. Otherwise stated, when the shaded area I which represents the integration of a voltage above the linear voltage G equals to the area H which represents the integration of the voltage above the reference $V_1$ which would be delivered from the linear integrator, the output from the RC circuit 100 equals to the output of the linear integrator 80. Therefore, the RC circuit 100 used in combination with the clamping circuit 200 can equally as well be used to act like a linear integrator.

Operation of the clipper 200 is hereinafter discussed in connection with FIGS. *7a* and *7b*. A signal with a waveform, for example, rectangular waveform (FIG. *7a*) is applied to the circuit 100 from the differential signal generator 14. In the absence of the clipper 200, the waveform of the output voltage developing at the junction 218 is similar to the waveform F in FIG. *6a*. However, owing to the presence of the clipper 200, the base voltage of the output signal developing at the junction 218 is equal to $v_2$ (at $T_0$) in that the voltage at the junction 218 is maintained at $v_2$ even when the signal from the differential signal generator 14 is less than $v_2$. Then, the voltage at the junction 218 gradually increases up to $v_1$ as shown in FIG. *7b* and remains thereat during a duration from $T_1$ to $T_2$. This is because a higher voltage than $v_1$ cannot be generated at the junction 218 in that the cathode of the diode 202 is biased by $v_1$. At the time $T_2$, the voltage in question gradually decreases until $V_2$ in that the anode of the diode 204 is biased by $V_z$ and remains thereat during a duration from $T_3$ to $T_4$, then repeating the above operation.

What is claimed is:

1. In a closed loop mixture control system for an internal combustion engine including exhaust means, means for generating a first signal representative of the deviation of the air-fuel ratio within said exhaust means from a desired air-fuel ratio, an integration circuit for providing integration of said first signal and mixture supplying means responsive to the output of said integration circuit to supply air and fuel in a variable ratio to said engine, wherein said integration circuit comprises:

an RC circuit, including a capacitor, for generating a second signal representative of the nonlinear integration of said first signal;

reference setting means for setting a predetermined voltage level, said predetermined voltage level being determined such that the nonlinear integration of said first signal by means of said RC circuit equals to the linear integration of said first signal by means of a linear integrator; and polarity sensitive means including clamping means for passing signals of a given polarity applied thereto when said predetermined voltage level is reached, the voltage developed across said capacitor of said RC circuit being clamped at said predetermined voltage level.

2. In a closed loop mixture control system for an internal combustion engine including exhaust means, means for generating a first signal representative of the deviation of the air-fuel ratio within said exhaust means from a desired air-fuel ratio, an integration circuit for providing integration of said first signal and mixture supplying means responsive to the output of said integration circuit to supply air and fuel in a variable ratio to said engine, wherein said integration circuit comprises:

an RC circuit, including a capacitor, for generating a second signal representative of the nonlinear integration of said first signal;

reference setting means for setting a predetermined voltage level, said predetermined voltage level being chosen such that the integration of a voltage which lies between a linearly varying voltage of a linear integrator and the nonlinearly varying voltage of said second signal and said predetermined voltage level equals to the integration of a voltage which lies between said predetermined voltage level and said linearly varying voltage which occurs before it intersects said nonlinearly varying voltage; and polarity sensitive means including clamping means for passing signals of a first polarity when said predetermined voltage level is reached, said polarity sensitive means being connected to pass current to said reference setting means, the voltage developed across said capacitor of said RC circuit being clamped to said predetermined voltage level.

* * * * *